US006543528B2

(12) United States Patent
Saito et al.

(10) Patent No.: US 6,543,528 B2
(45) Date of Patent: Apr. 8, 2003

(54) HEAT EXCHANGER

(75) Inventors: Katsuhiro Saito, Nishi-kasugai-gun (JP); Masashi Inoue, Nishi-kasugai-gun (JP); Yoshinori Watanabe, Nagoya (JP); Akira Yoshikoshi, Nagoya (JP); Kazuhiro Suzuki, Nishi-kasugai-gun (JP); Yujiro Anai, Nagoya (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/956,874

(22) Filed: Sep. 21, 2001

(65) Prior Publication Data

US 2002/0038701 A1 Apr. 4, 2002

(30) Foreign Application Priority Data

Sep. 22, 2000 (JP) ..... 2000-289443
Oct. 3, 2000 (JP) ..... 2000-304134
Oct. 3, 2000 (JP) ..... 2000-304135

(51) Int. Cl.[7] ..... F28F 27/02
(52) U.S. Cl. ..... 165/153; 165/152; 165/174
(58) Field of Search ..... 165/153, 174

(56) References Cited

U.S. PATENT DOCUMENTS 5,651,268 A * 7/1997 Aikawa et al. ..... 138/44
5,979,544 A 11/1999 Inoue
6,338,383 B1 * 1/2002 Abdulnour et al. ..... 165/153

FOREIGN PATENT DOCUMENTS

JP 62-268988 11/1987
JP 10-325646 12/1998

* cited by examiner

*Primary Examiner*—Allen Flanigan
(74) *Attorney, Agent, or Firm*—Oblon, Spivak, McClelland, Maier & Neustadt, P.C.

(57) ABSTRACT

The present invention relates to a heat exchanger in which a plate-shaped refrigerant flow portion which provides an internal refrigerant flow path by overlaying two flat plates formed by drawing and a cooling fin are alternately layered; and comprising an opening portion provided on each of the flat plates and which is connected with the refrigerant flow path; and a continuous space for the flow of the refrigerant which is provided by connecting the opening portions of adjacent refrigerant flow portions. The refrigerant which flows in the space is distributed to the respective refrigerant flow paths through the opening portions. The heat exchanger further comprises a means for improving the heat exchange capacity, and this means is, for example, a narrowing means which is provided at the upstream end part of the space in order to uniformly distribute the refrigerant to the refrigerant flow paths.

5 Claims, 14 Drawing Sheets

HEAT EXCHANGER

BACKGROUND OF THE INVENTION

1. Field of the Invention

The present invention relates to a heat exchanger which is used for an air conditioner.

2. Description of the Related Art

FIGS. 7 to 14 show examples of structures of heat exchangers which are used as evaporators for vehicular air conditioners and the like. The heat exchangers shown in these figures are called drawn-cup type heat exchangers, and each air conditioner is constructed by alternately overlaying plate shaped refrigerant passage portions and corrugated plate shaped cooling fins.

In FIGS. 7 and 8, reference numeral 11 denotes the refrigerant flow portions and reference numeral 12 denotes the cooling fins. The refrigerant flow portion 11 is obtained by overlaying substantially rectangular flat plates 13 and 14 which are formed by drawing, and brazing at the outer peripheral portions and the central portions thereof. A refrigerant inlet 15 and a refrigerant outlet 16 are provided side by side at the lower end part of the refrigerant flow portion 11, and an inverted U-shaped refrigerant flow path R which extends upwardly from the refrigerant inlet 15 and turns downwards at the top of the refrigerant flow portion 11 toward the refrigerant outlet 16, is formed within the refrigerant flow portion 11.

A plurality of dimples 17 are formed in the refrigerant flow portion 11 by denting the flat plates 13 and 14 which form the refrigerant flow path R from the outside, and these dimples 17 form a plurality of bulged portions 18 in the refrigerant flow path R. Furthermore, the left end of the laminated refrigerant flow portions 11 and cooling fins 12 are covered by a side plate 19. Hereinafter, the left end of each figure is referred to as the "proximal end" and the right end of each Figure is referred to "distal end".

The refrigerant inlet 15 is composed of opening portions 13*a* and 14*a* formed in the flat plates 13 and 14, and the refrigerant inlets 15 of the respective refrigerant flow portions 11 are directly overlaid with no intervening cooling fin 12, so that a continuous space Sa is formed. Similarly, the refrigerant outlet 16 is composed of opening portions 13*a* and 14*a* formed in the flat plates 13 and 14, and the refrigerant outlets 16 of the respective refrigerant flow portions 11 are directly overlaid with no intervening cooling fins 12, so that a continuous space Sb is formed. The proximal end of the space Sa is connected with a refrigerant inlet pipe 20 which extends from the central part of the height of the heat exchanger, and the proximal end of the space Sb is connected with a refrigerant outlet pipe 21. Furthermore, the distal end of each space Sa, Sb is closed by a cover which is not shown in Figures.

In this heat exchanger, refrigerant which flows into the space Sa through the refrigerant inlet pipe 20 is distributed to each of the refrigerant flow paths R, undergoes heat exchange while it passes through the refrigerant flow paths R, and then is collected at the space Sb and exits from the refrigerant outlet pipe 21.

The heat exchanger shown in FIGS. 9 to 11 provides the refrigerant inlet 15 and the refrigerant outlet 16 at the upper end part of the refrigerant flow portion 11, and a U-shaped refrigerant flow path R which extends downwards from the refrigerant inlet 15 and turns upwards at the bottom of the refrigerant flow portion 11 towards the refrigerant outlet 16 is formed within the refrigerant flow portion 11. Furthermore, in this air conditioner, the bulged portions 18 are not provided, and a corrugated inner fin 18*a* is sandwiched between each of the flat plates 13 and 14. In addition, the proximal end of the space Sa is connected with the refrigerant inlet pipe 20 via a header 22, and the distal end of the space Sb is connected with the refrigerant outlet pipe 21 via a header 23.

In this heat exchanger, refrigerant which flows into the space Sa from the refrigerant inlet pipe 20 through the header 22 is distributed to each of the refrigerant flow paths R, undergoes heat exchange while passing through the refrigerant flow path R, and then is collected at the space Sb and exists from the refrigerant outlet pipe 21.

The heat exchanger shown in FIGS. 12 to 14 further provides an opening 24 which opens adjacent to each refrigerant inlet 15 and refrigerant outlet 16, and the openings 24 of the refrigerant flow portions 11 are overlaid with no intervening cooling fins 12 so that a continuous space (forward flow path) Sc is formed. Further, the space Sa is divided into two spaces Sa-1 and Sa-2 in the longitudinal direction by a partitioning wall 25. Furthermore, a cover 26 is fixed on the distal end of the heat exchanger, so that a turning portion 27 which connects the distal ends of spaces Sc and Sa-1 is formed by the cover 26. In addition, the proximal end of the space Sc is connected with the refrigerant inlet pipe 20 and the proximal end of the space Sa is connected with the refrigerant outlet pipe 21, and both ends of the space Sb are closed by covers 28.

In this heat exchanger, the flow of the refrigerant which flows into the space Sc through the refrigerant inlet pipe 20 is turned at the turning portion 27 and flows into the space Sa-1 and is distributed to the refrigerant flow portions 11 at the distal end side of the heat exchanger. The refrigerant undergoes heat exchange while it passes through each of the refrigerant flow paths R, and is collected at the space Sb. The refrigerant is further distributed to the refrigerant flow portions 11 at the proximal end side of the heat exchanger and passes through each refrigerant flow path R, and is collected at the space Sa-2, and then, the refrigerant exists from the refrigerant outlet pipe 21.

However, when the refrigerant inlet pipe 20 has a 90 degree curve adjacent to the space Sa as denoted by symbol A in FIG. 7 for example, the flow of the refrigerant is slowed down due to the curve, and therefore, the refrigerant may not reach the innermost regions (the distal end part) of the space Sa, and the refrigerant may not flow to the distal end part of the space Sa. As a result, the refrigerant may not be uniformly distributed throughout the respective refrigerant flow paths R, and consequently, the problem that heat exchange is not sufficient at the refrigerant flow paths R at the distal end part may occur.

Furthermore, the heat exchangers as described above are manufactured by braze welding. For example, in the heat exchanger shown in FIGS. 10 and 11, the refrigerant flow portion 11 is constructed by brazing the flat plates 13 and 14 at flange portions 13*c* and 14*c* which are provided on the outer peripheral portions thereof as shown in FIG. 11. In addition, adjacent refrigerant inlets 15 (or refrigerant outlets 16) are fastened by brazing a flange-shaped side wall 13*d* which is formed at each opening portion 13*a* (or 14*b*) and a flange-shaped side wall 14*d* which is formed at adjacent opening portion 14*a* (or 13*b*). However, in the latter case, the fastening positions of the refrigerant inlets 15 or refrigerant outlets 16 protrude into the space Sa or Sb and give rise to resistance to the flow of fluid (refrigerant) in the space Sa or Sb. As a result, the pressure loss of the fluid which passes the space Sa or Sb caused by the resistance increases to a significant level, and the heat exchange capacity of the heat exchanger decreases.

Moreover, in recent years, the cooling fins 12 and flat plates 13, 14 have become thinner, in compliance with the demand for reducing the weight and size of the heat exchanger. However, in case of the heat exchanger as shown in FIGS. 12 to 14, it is difficult to reduce the thickness of the turning portion 27 which receives the pressure of the flow of the refrigerant without reducing its strength.

The present invention was made in consideration of the above-mentioned circumstances, and a first object of the present invention is to uniformly distribute the refrigerant in the space Sa and improve the heat exchange capacity of the heat exchanger. Further, a second object of the present invention is to reduce the pressure loss of the refrigerant in the space Sa or Sb and improve the heat exchange capacity of the heat exchanger. Furthermore, a third object of the present invention is to provide the heat exchanger with a reduced weight and a minimized size while maintaining the strength of the turning portion 27.

SUMMARY OF THE INVENTION

The present invention relates to a heat exchanger in which a plate-shaped refrigerant flow portion which provides an internal refrigerant flow path by overlaying two flat plates formed by drawing and a cooling fin are alternately layered; comprising an opening portion provided on each of the flat plates and which is connected with the refrigerant flow path, and a continuous space for the flow of the refrigerant which is provided by connecting the opening portions of adjacent refrigerant flow portions; wherein the refrigerant which flows in the space is distributed to the respective refrigerant flow paths through the opening portions.

Particularly, the heat exchanger of the present invention is characterized by comprising a means for improving the heat exchange capacity. This means is a narrowing means which is provided at an upstream end part of the space in order to uniformly distribute the refrigerant to the respective refrigerant flow paths, for example.

In this case, it is preferable to provide a rectifier which rectifies the flow of the refrigerant along the longitudinal direction of the space at a downstream end side of the space, and it is further preferable to provide the rectifier adjacent to the narrowing means.

A tubular portion which projects substantially perpendicularly to the flat plates may be provided at each of the opening portions of the respective refrigerant flow portions as the means for improving the heat exchange capacity. The tubular portion which is provided at one of the refrigerant flow portions is inserted into the tubular portion of the adjacent refrigerant flow portion so as to closely seal the outer and inner peripheral surface of these tubular portions.

In this case, it is preferable that the diameter of an end part of the tubular portion of the adjacent refrigerant flow portion has a uniform diameter which is larger than that of the inserted tubular portion, or to have a diameter which is gradually enlarged in the longitudinal direction so as to be larger than that of the inserted tubular portion.

Furthermore, the present invention is also characterized by comprising a forward flow path in which the refrigerant flows from the proximal end of the heat exchanger to the distal end thereof, and a turning portion which is provided at the distal end and the direction of flow of the refrigerant which flows from the forward flow path to the space; wherein the turning portion is a concave portion which is formed on a plate member which overlays the distal end surface of the heat exchanger, and a back surface of the turning portion is supported by a side plate which overlays the distal end surface of the plate member.

In this case, it is preferable that the turning portion has a center portion which forms a flat surface and a peripheral portion which forms a curved surface which smoothly continues from the center portion, and it is further preferable that a plurality of projecting portions which project along the direction of the thickness of the plate member are formed on the peripheral portion.

DESCRIPTION OF THE PREFERRED EMBODIMENTS

Preferred embodiments of the present invention will be described in the following with reference to the Figures. In the following description, members having the same structure as the conventional heat exchangers shown in FIGS. 7 to 14 are denoted by the same reference symbols as in these figures, and explanations thereof are omitted.

Figure 1:
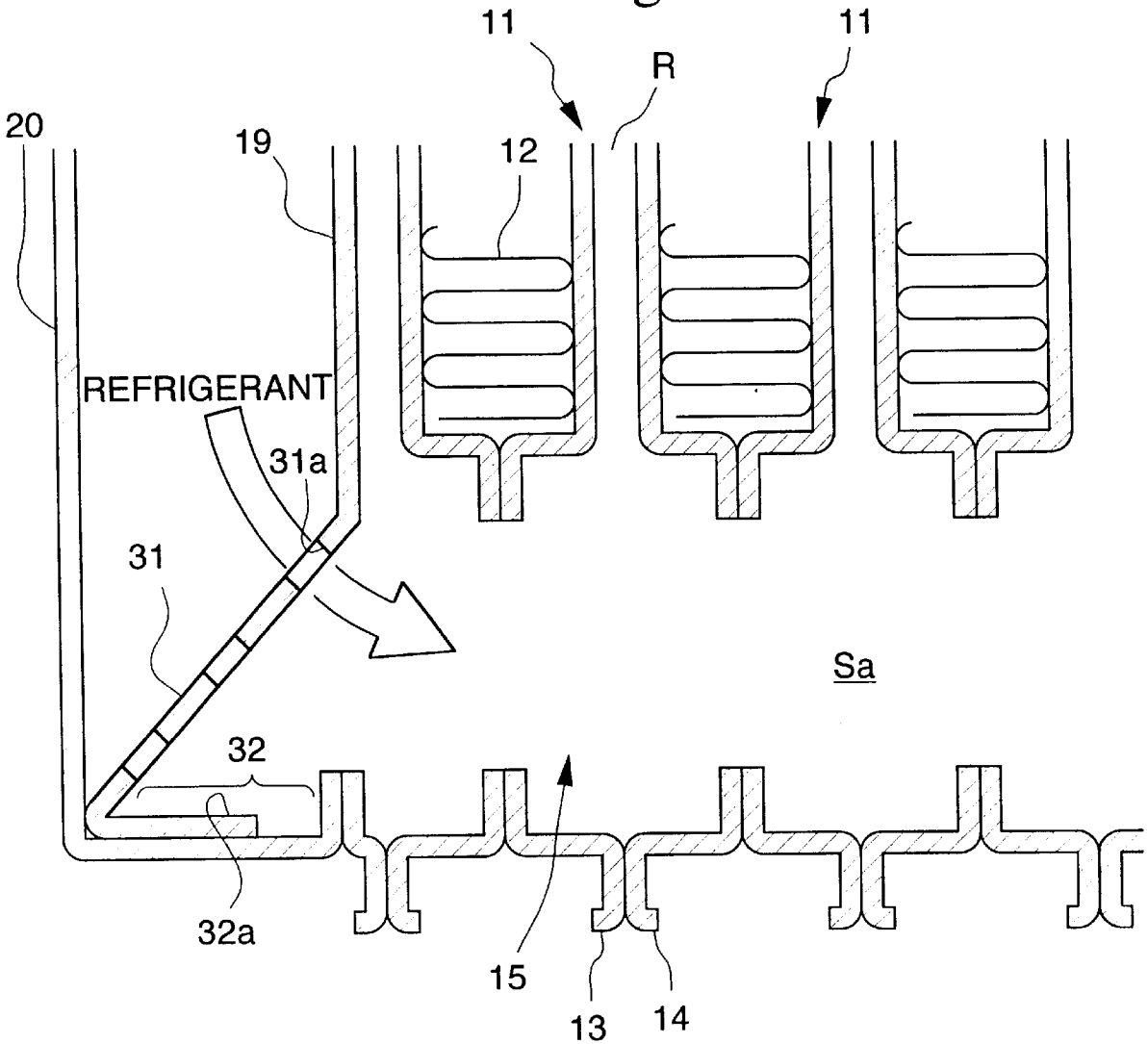
FIG. 1 is a cross sectional view showing a connecting portion of the refrigerant inlet pipe and the space in the first embodiment of the heat exchanger according to the present invention.

An embodiment of the present invention is shown in FIG. 1. FIG. 1 shows a cross sectional view of the connecting portion of the refrigerant inlet pipe 20 and the space Sa, and a porous plate (narrowing means) 31 formed by an extension of the lower end of the side plate 19, is provided at the portion where the refrigerant inlet pipe 20 connects with the refrigerant inlet 15 located at the upstream end of the space Sa. The porous plate 31 has one or a plurality of pores 31*a*, and a piece of punched metal or a wire mesh can also be used as the porous plate 31. The porous plate 31 is inclined at an angle of 45 degrees, and it separates the lower end of the refrigerant inlet pipe 20 and the refrigerant inlet 15. Furthermore, a straight portion (rectifier) 32 which bends towards the refrigerant inlet 15 side at the downstream end side of the porous plate 31 is provided directly under the porous plate 31. The straight portion 32 is for rectifying the flow direction of the refrigerant along the longitudinal direction of the space Sa, and a horizontal plane 32*a* which has a predetermined length in the longitudinal direction of the space Sa is provided on the upper surface of the straight portion 32. The remainder of the structure of the heat exchanger is the same as that of the heat exchanger shown in FIGS. 7 and 8.

In the heat exchanger having the above structure, the refrigerant supplied by the refrigerant inlet pipe 20 is converted into a mist when it passes the porous plate 31, and the refrigerant is accelerated to obtain a flow which is sufficient to reach the innermost regions of the space Sa. As a result, the refrigerant is uniformly distributed throughout to all the refrigerant flow paths R, and the heat exchange capacity of the heat exchanger is improved. Furthermore, the flow of the refrigerant which passes the straight portion 32 is guided by the horizontal plane 32*a* and rectified along the longitudinal direction of the space Sa. Therefore, an effect which of curvature in the path of the refrigerant when it passes through the connecting portion of the refrigerant inlet pipe 20 and the space Sa is decreased, and the refrigerant is more uniformly distributed throughout the refrigerant flow paths R. Moreover, since the straight portion 32 is provided directly under the porous plate 31, the effect of the curvature of the path of the refrigerant is more effectively decreased, and the refrigerant is more uniformly distributed throughout the refrigerant flow paths R.

In addition to the porous plate 30, the following structures can be used as the narrowing means.

Figure 2A:
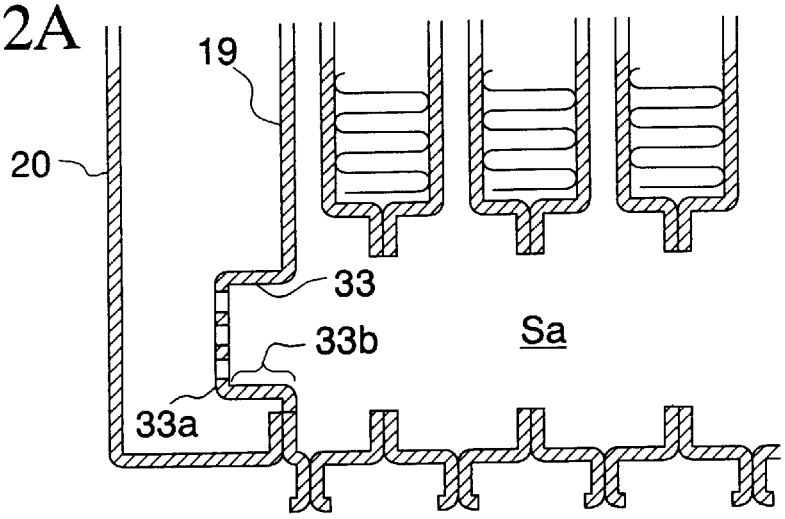
FIG. 2A is a cross sectional view showing a connecting portion of the refrigerant inlet pipe and the space in another embodiment of the heat exchanger according to the present invention.
Figure 2B:
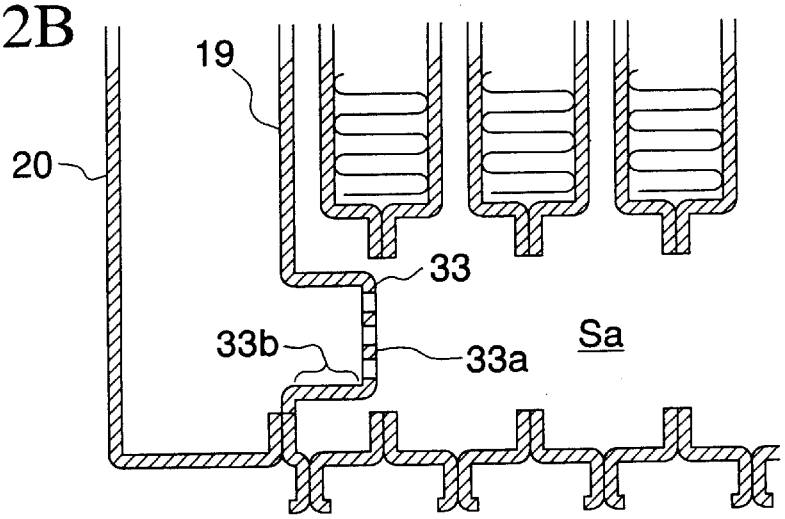
FIG. 2B is a cross sectional view showing a connecting portion of the refrigerant inlet pipe and the space in another embodiment of the heat exchanger according to the present invention.

FIGS. 2A and 2B show a pipe 33 which is provided at the inlet side of the space Sa and projects toward the upstream or downstream end of the space Sa in the longitudinal direction of the space Sa, and a porous plate 33*a* which is provided on the end surface of the pipe 33. In these embodiments, the inner surface of the pipe 33 acts as the straight portion 33*b*. Otherwise, as shown in FIG. 2C, it is possible to provide a porous plate 34 at the connecting portion between the space Sa and refrigerant inlet pipe 20, of the side plate 19.

Figure 2C:
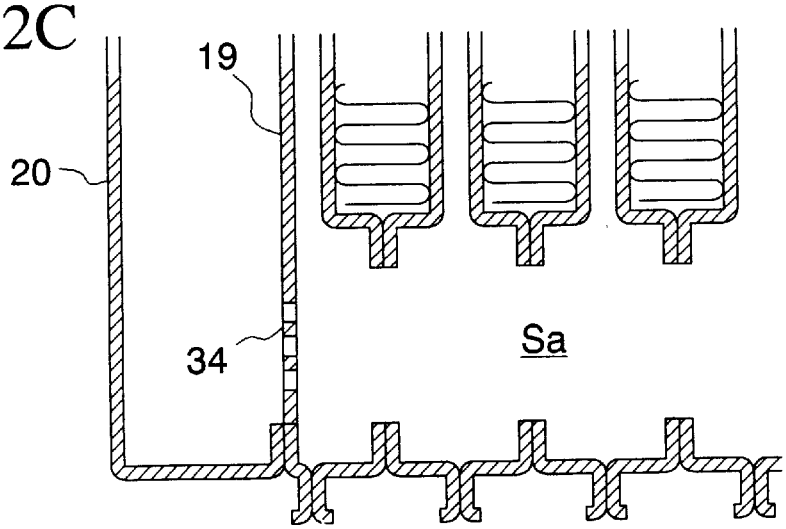
FIG. 2C is a cross sectional view showing a connecting portion of the refrigerant inlet pipe and the space in another embodiment of the heat exchanger according to the present invention.

While the above embodiments describe cases in which the refrigerant inlets 15 and refrigerant outlets 16 are provided side by side at the lower end parts of the heat exchangers, the narrowing means as shown in FIG. 1 through FIG. 2C can also be provided when the refrigerant inlet 15 and refrigerant outlet 16 are provided side by side at the upper end part of the heat exchanger, or when one of the refrigerant inlet 15 or refrigerant outlet 16 is provided at the upper end part of the heat exchanger and the other of the refrigerant inlet 15 or refrigerant outlet 16 is provided at the lower end part of the heat exchanger.

Figure 3:
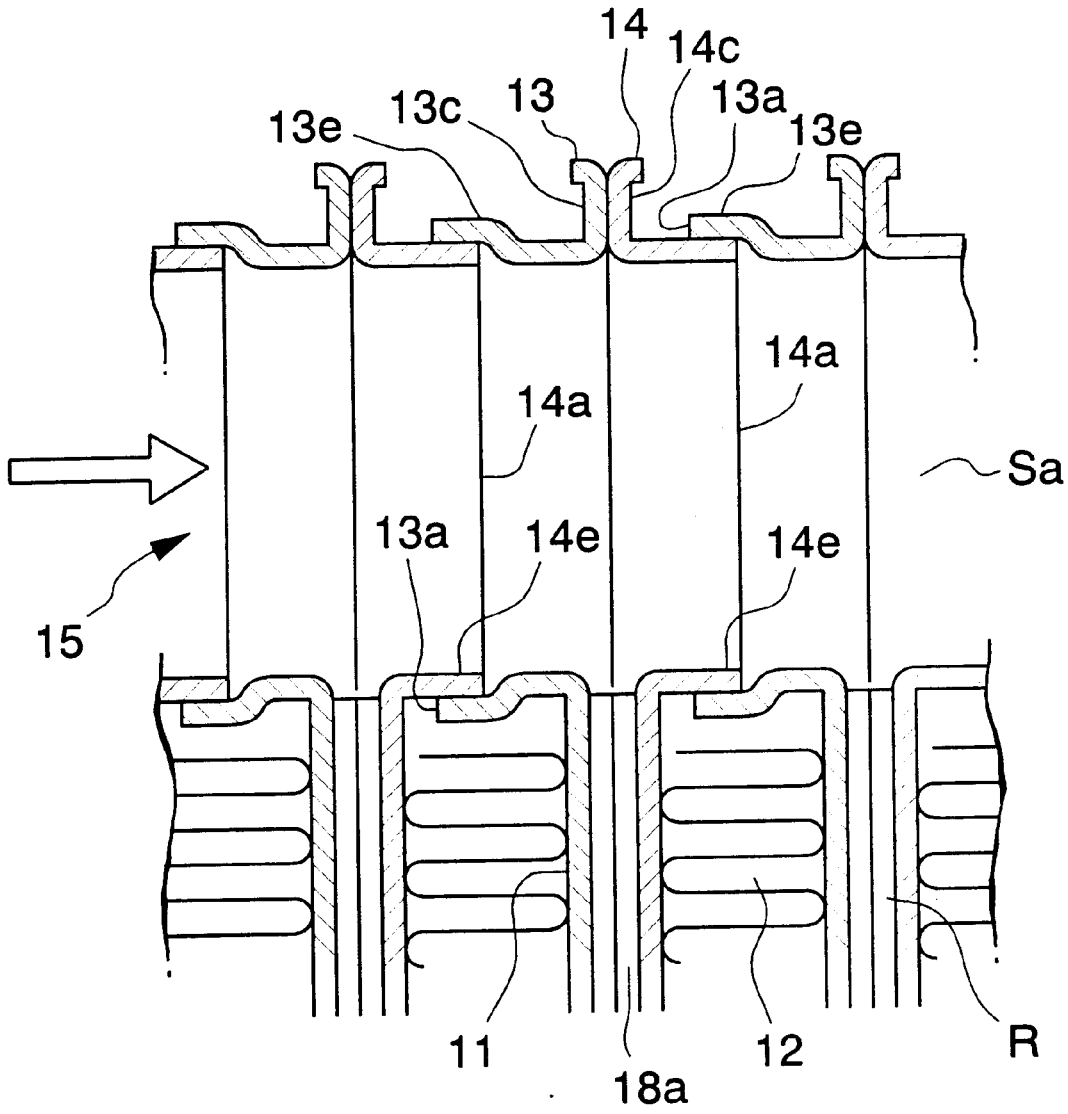
FIG. 3 is a cross sectional view showing a region including the vicinity of the space in another embodiment of the heat exchanger according to the present invention.

Another embodiment of the heat exchanger according to the present invention is disclosed in FIG. 3. FIG. 3 is a cross sectional view showing a region including the vicinity of the space Sa. In this heat exchanger, a tubular portion 13*e* which extends perpendicular to the flat plates 13, 14 and has a uniform enlarged diameter is provided at the proximal end part of the opening portion 13*a* (the end part not having the flange portion 13*c*), and a tubular portion 14*e* which extends perpendicular to the flat plates 13, 14 and has a uniform diameter which is not enlarged, is provided at the distal end part of the opening portion 14*a* (the end part not having the flange portion 14*c*), of a pair of flat plates 13, 14 which form the refrigerant flow portions 11. Furthermore, the tubular portions 13*e*, 14*e* are positioned in order to have the same axis as the opening portions 13*a*, 14*a*, and the tubular portions 13*e*, 14*e* of the adjacent refrigerant flow portions 11 face each other when the heat exchanger is assembled. The remainder of the structure of the heat exchanger is the same as that of the heat exchanger shown in FIGS. 9 to 11.

The flat plates 13 and 14 are fastened by brazing the flange portions 13*c* and 14*c* which are provided on the outer peripheral portions thereof. In addition, adjacent refrigerant inlets 15 are overlaid by inserting the tubular portion 14*e* into the tubular portion 13*e* of the adjacent refrigerant flow portion 11 so as to closely contact the inner peripheral surface of the tubular portion 13*e* and the outer peripheral surface of the tubular portion 14*e*, and brazing these surfaces. And as a result of overlaying these refrigerant inlets 15, the space Sa which has a tubular shape and no projections on its inner peripheral surface is formed.

Here, the space Sb formed by overlaying the refrigerant outlets 16 also has the same structure as described above, though it is not shown in the figures.

In the heat exchanger having the above structure, since there are no projections in the inner peripheral surface of the space Sa (or the Space Sb), the pressure loss of the fluid which passes through the space Sa (or the Space Sb) is decreased, and the heat exchange capacity of the heat exchanger is improved.

The structure of the connecting portion of the flat plates 13, 14 can be modified as follows.

Figure 4:
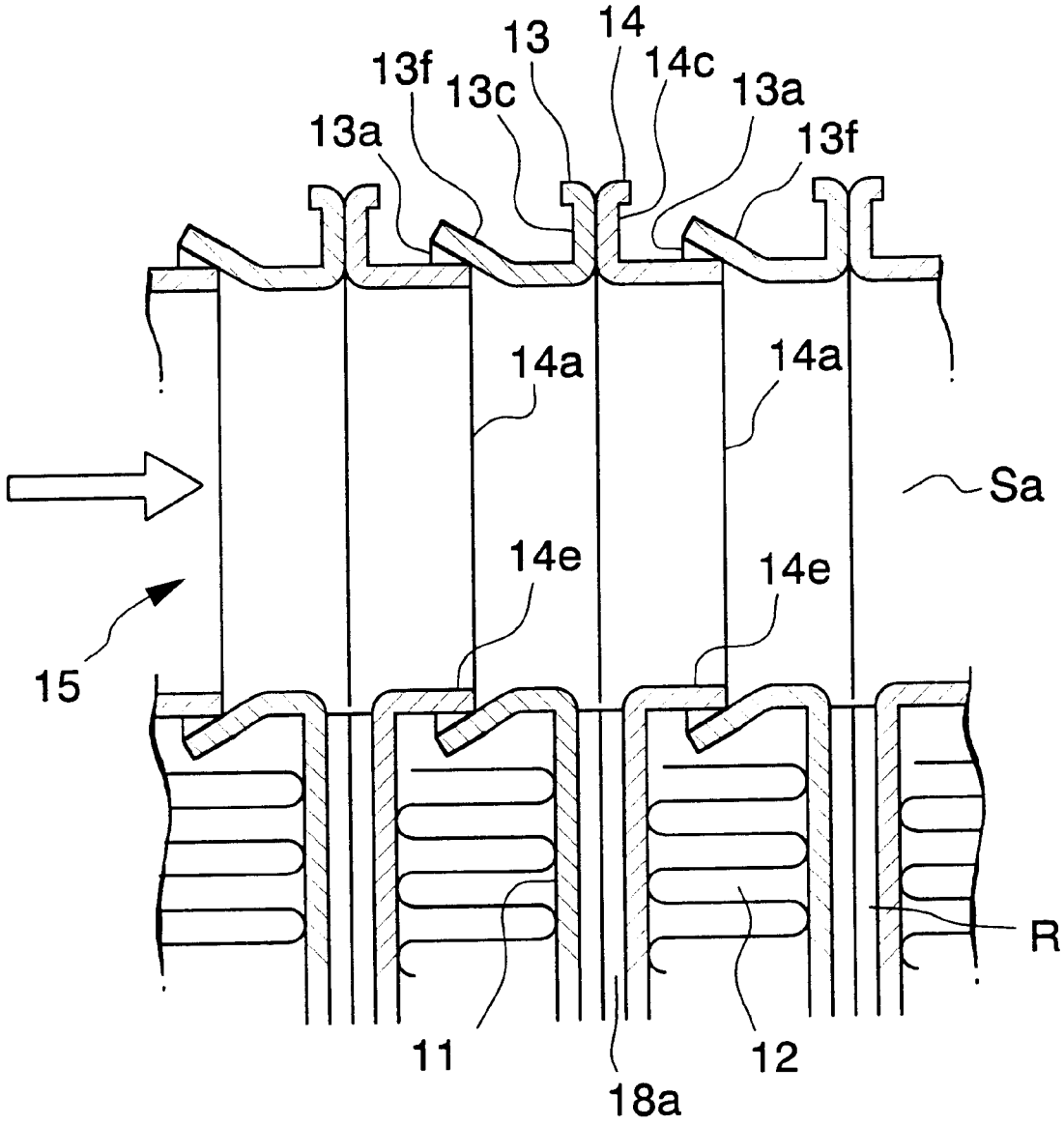
FIG. 4 is a cross sectional view showing a region including the vicinity of the space in another embodiment of the heat exchanger according to the present invention.

FIG. 4 is a cross sectional view showing a region including the vicinity of the space Sa in another embodiment of the heat exchanger. In this embodiment, a tubular portion 13*f* which extends substantially perpendicular to the flat plates 13, 14, and having a diameter which is gradually enlarged toward the edge of the opening portion 13*a*, is provided in place of the tubular portion 13*e*. The remainder of the structure of the heat exchanger is the same as that of the heat exchanger shown in FIG. 3.

The flat plates 13 and 14 are fastened by brazing the flange portions 13*c* and 14*c* which are provided on the outer peripheral portions thereof. In addition, adjacent refrigerant inlets 15 are overlaid by inserting the tubular portion 14*e* into the tubular portion 13*f* of the adjacent refrigerant flow portion 11 so as to closely contact the inner peripheral surface of the tubular portion 13*f* and the outer peripheral surface of the tubular portion 14*e*, and brazing these surfaces. And as a result of overlaying these refrigerant inlets 15, the space Sa, which has a tubular shape and no projections on its inner peripheral surface, is formed.

Here, the space Sb formed by overlaying the refrigerant outlets 16 also has the same structure as described above, though it is not shown in the figures.

In the heat exchanger having the above structure, similarly to the heat exchanger shown in FIG. 3, since there are no projections in the inner peripheral surface of the space Sa (or the Space Sb), the pressure loss of the fluid which passes through the space Sa (or the Space Sb) is decreased, and the heat exchange capacity of the heat exchanger is improved.

In addition, in the above embodiments, cases in which the refrigerant inlets 15 and refrigerant outlets 16 are provided side by side at the upper end parts of the heat exchangers are described. However, structures such as those shown in FIGS. 3 and 4 can also be provided when the refrigerant inlet 15 and refrigerant outlet 16 are provided side by side at the lower end part of the heat exchanger or when one of the refrigerant inlet 15 or refrigerant outlet 16 is provided at the upper end part of the heat exchanger and the other of the refrigerant inlet 15 or refrigerant outlet 16 is provided at the lower end part of the heat exchanger.

Figure 5:
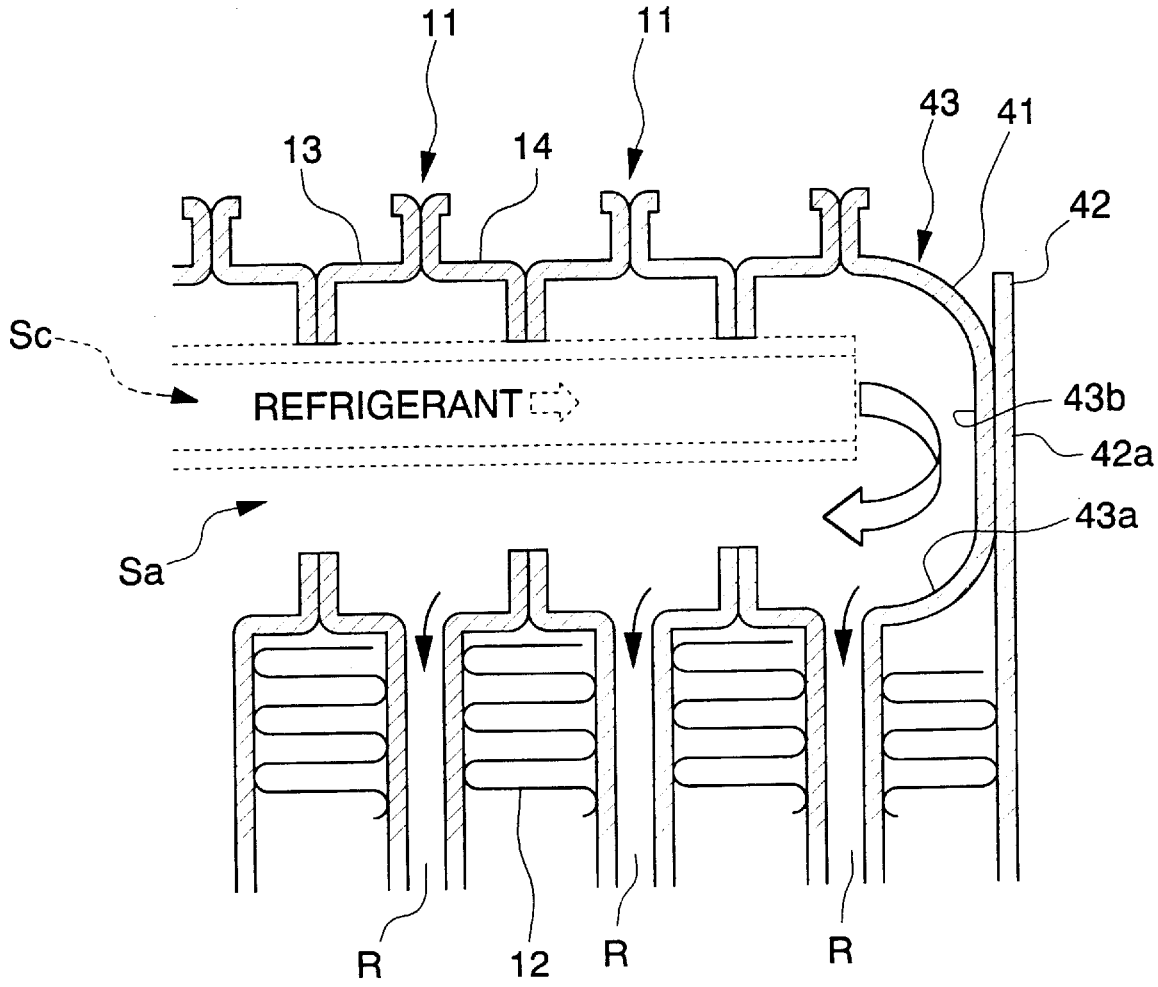
FIG. 5 is a cross sectional view showing a region including the vicinity of the distal end part of the space in another embodiment of the heat exchanger according to the present invention.
Figure 6:
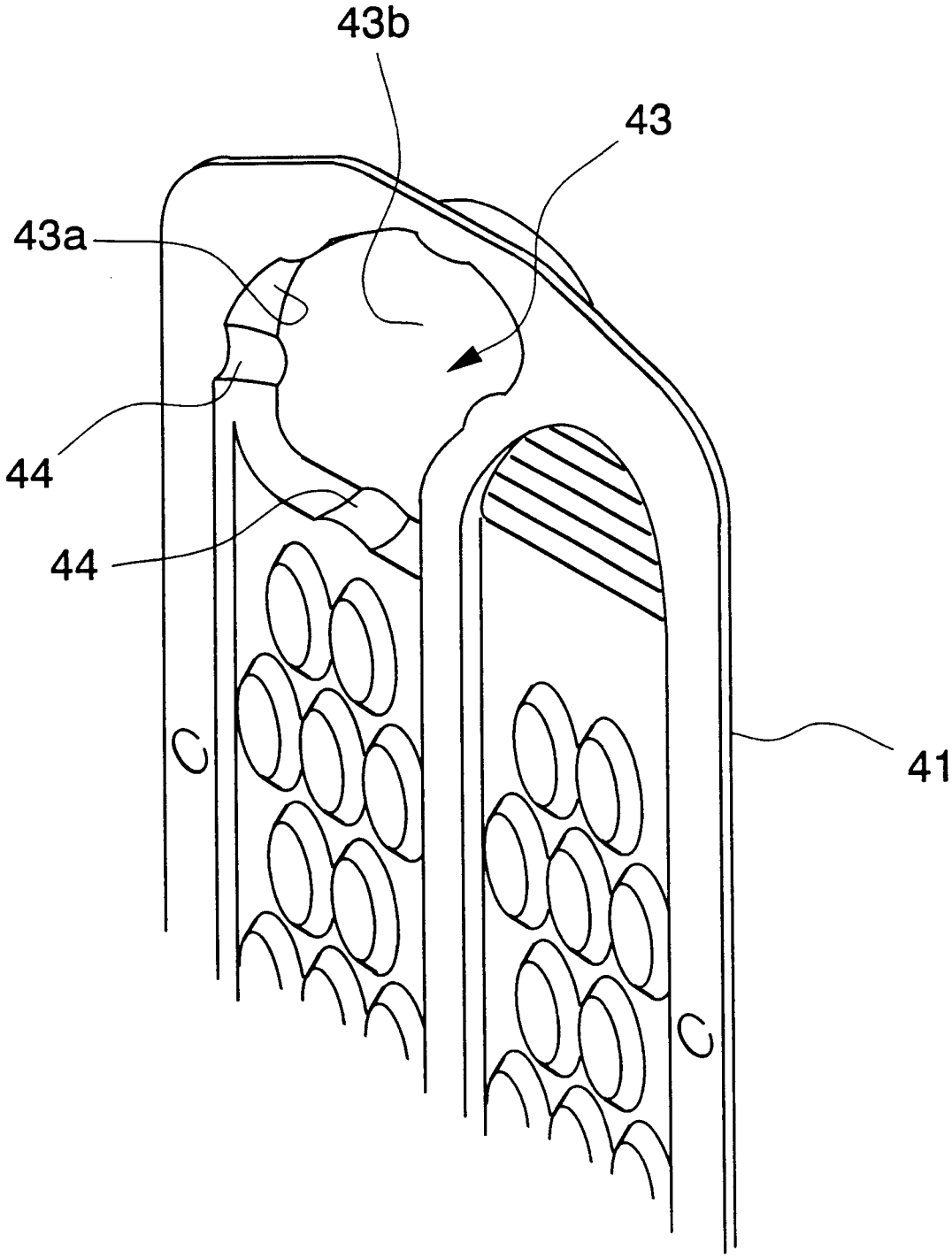
FIG. 6 is a perspective view showing an example of the plate member in which the turning portion is provided.
Figure 7:
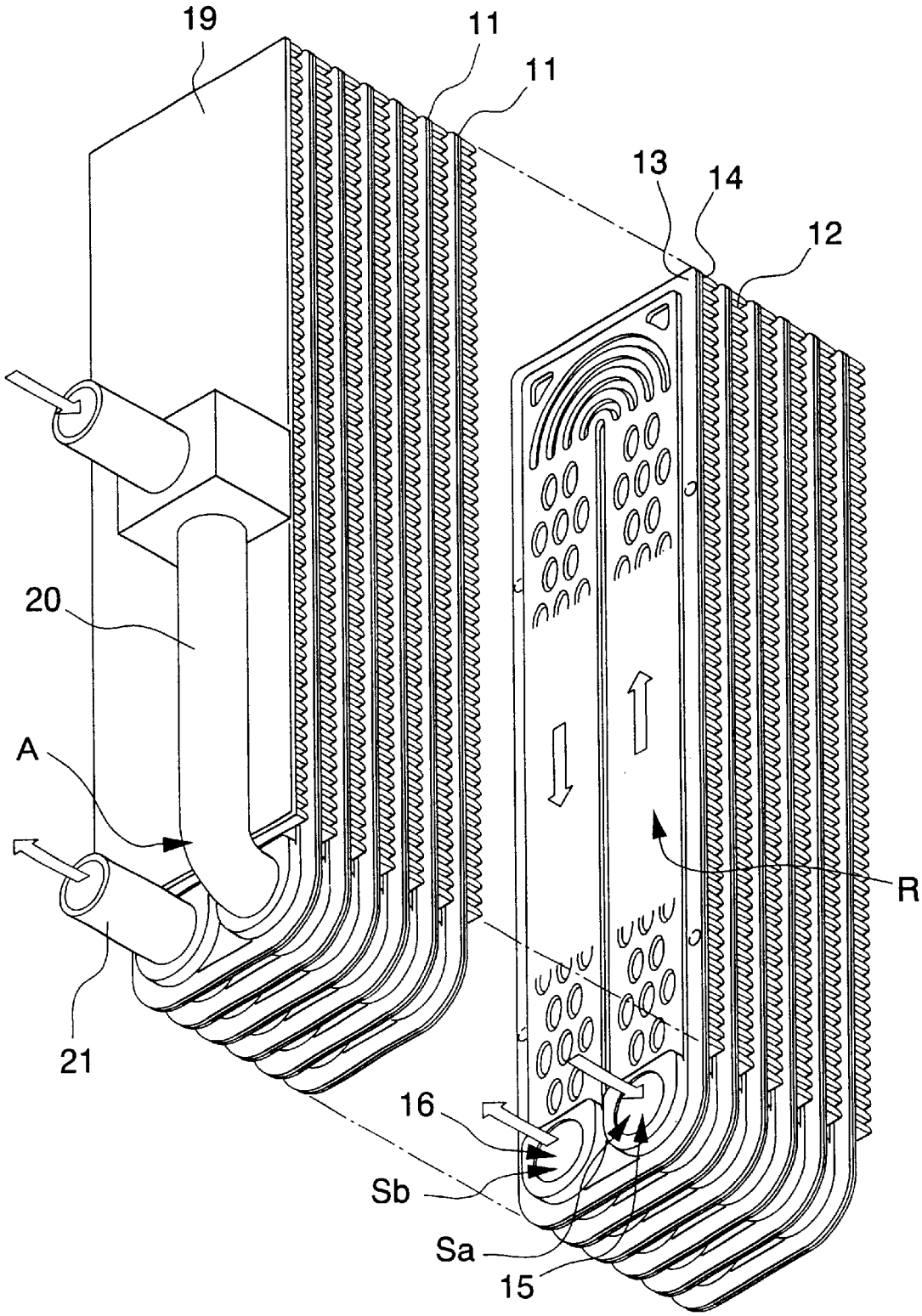
FIG. 7 is a perspective view showing an example of the structure of a conventional heat exchanger.
Figure 8:
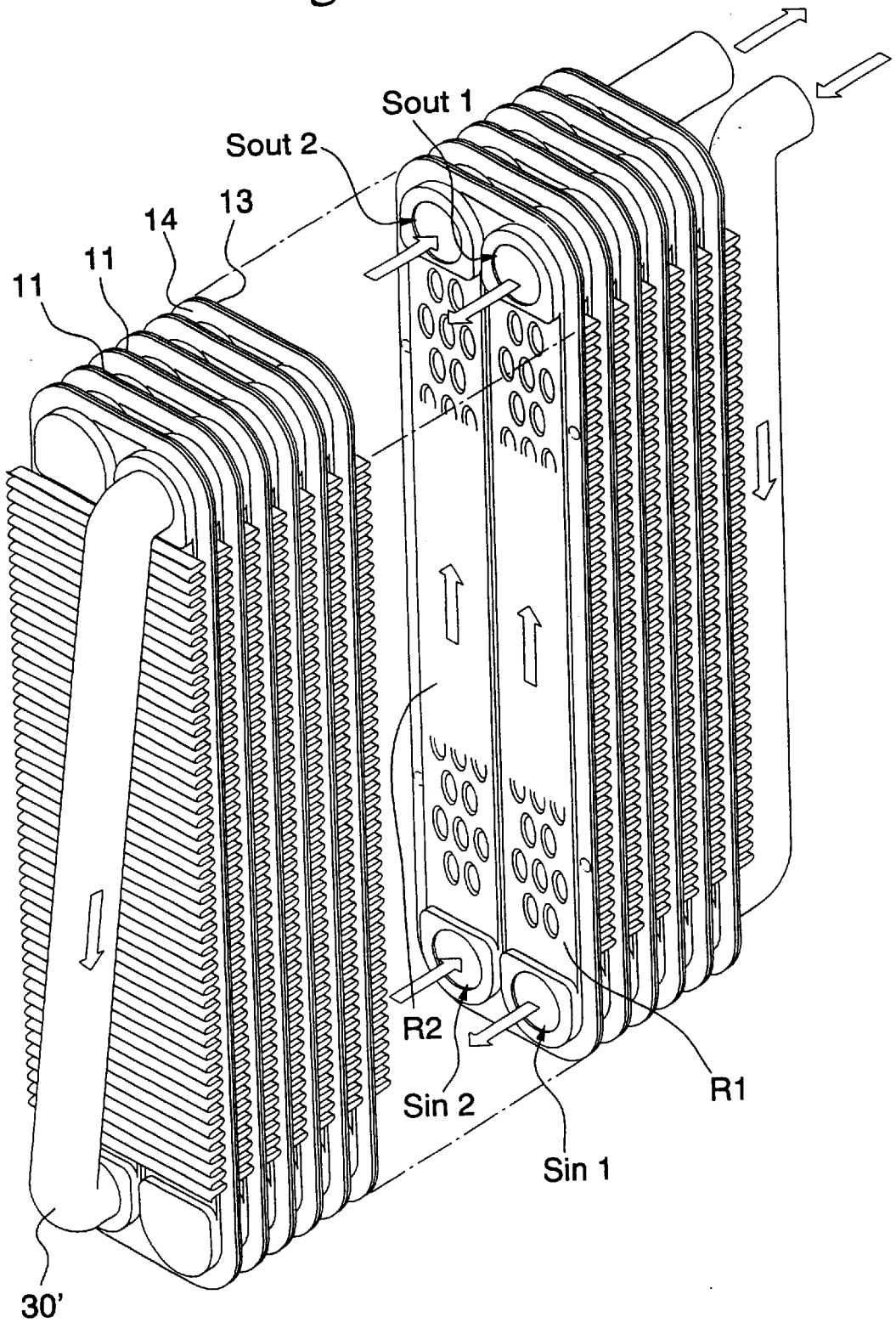
FIG. 8 is a perspective view showing the structure of the refrigerant flow portion of the heat exchanger shown in FIG. 7.
Figure 9:
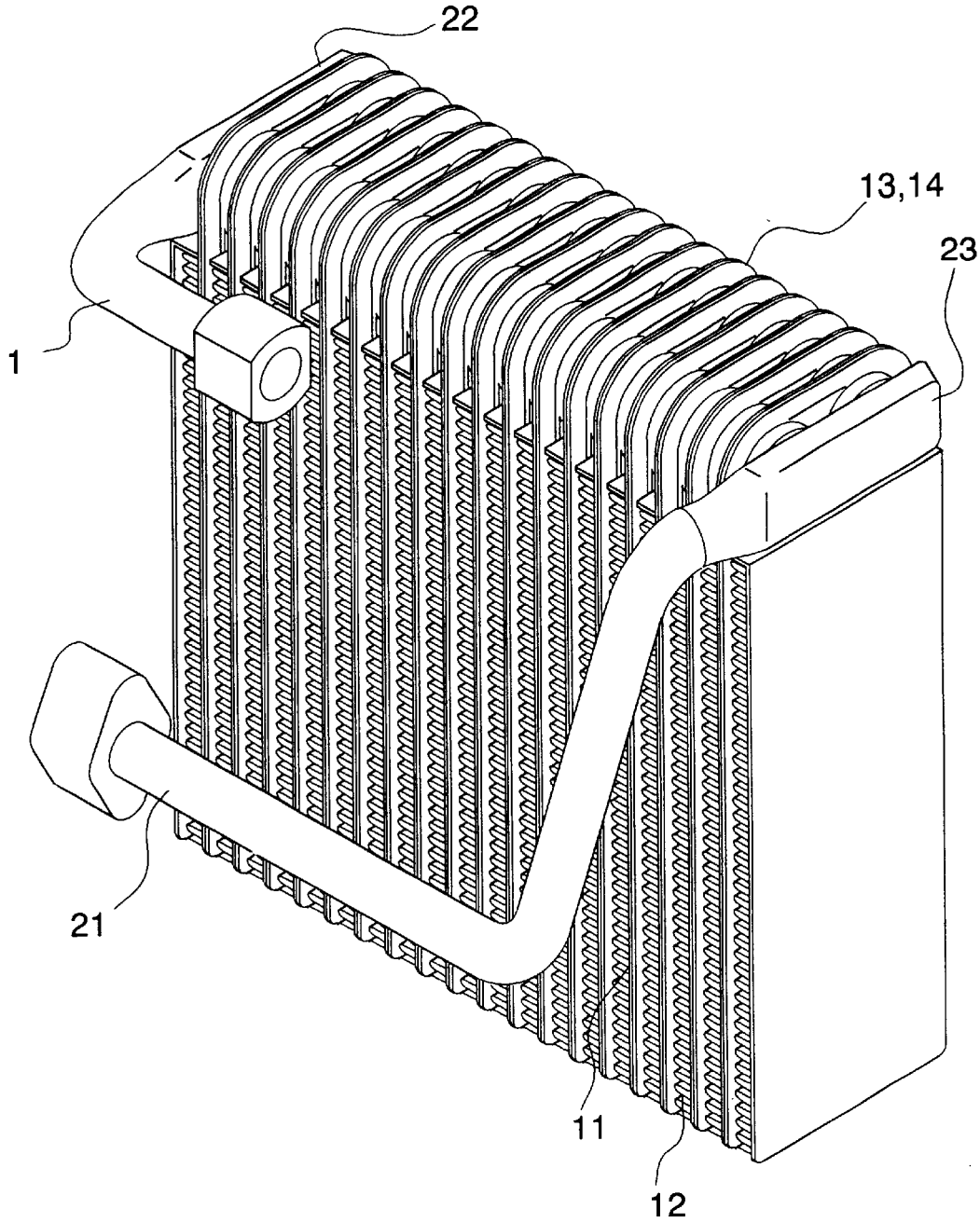
FIG. 9 is a perspective view showing an example of the structure of a conventional beat exchanger.
Figure 10:
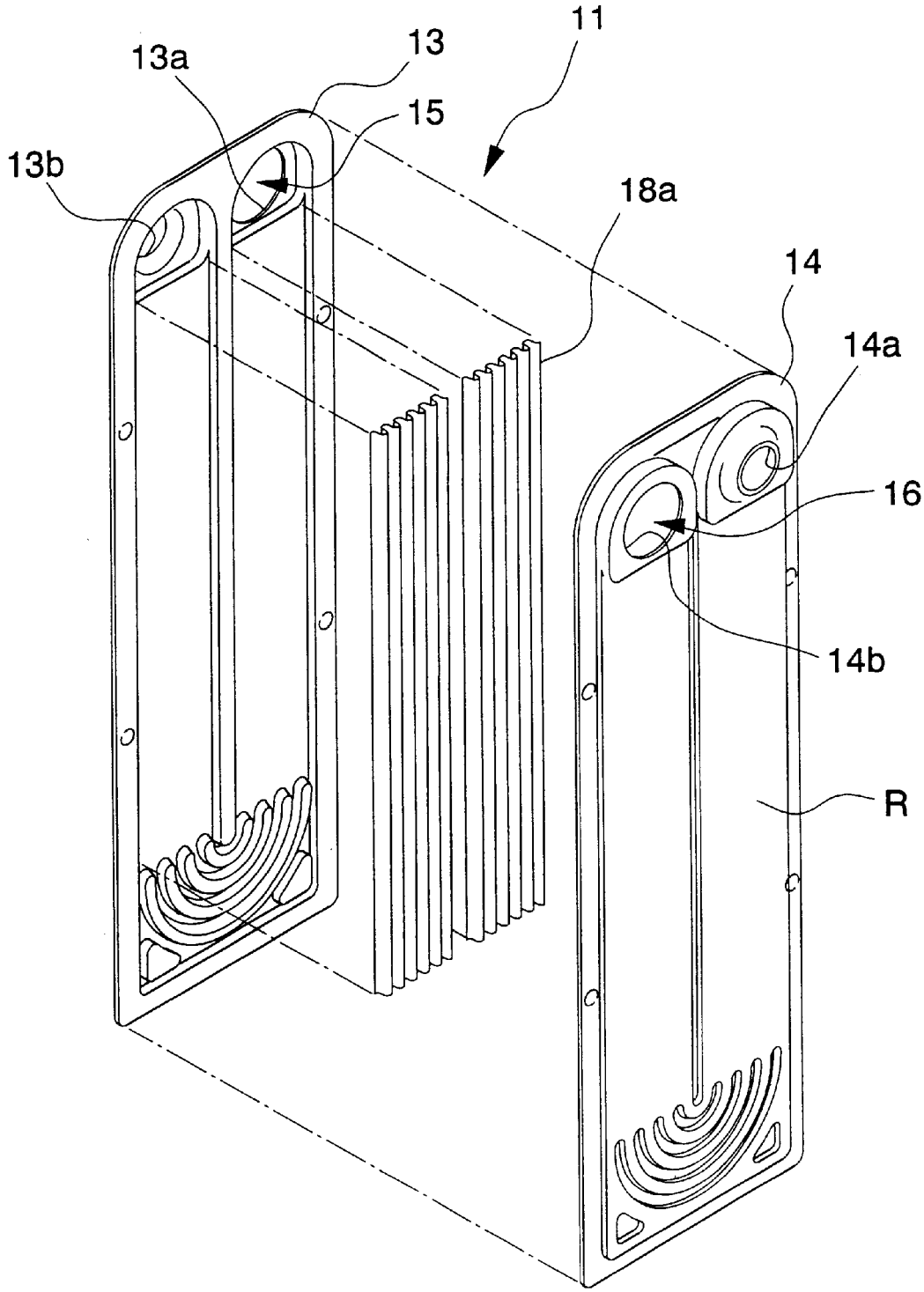
FIG. 10 is a perspective view showing the structure of the refrigerant flow portion of the heat exchanger shown in FIG. 9.
Figure 11:
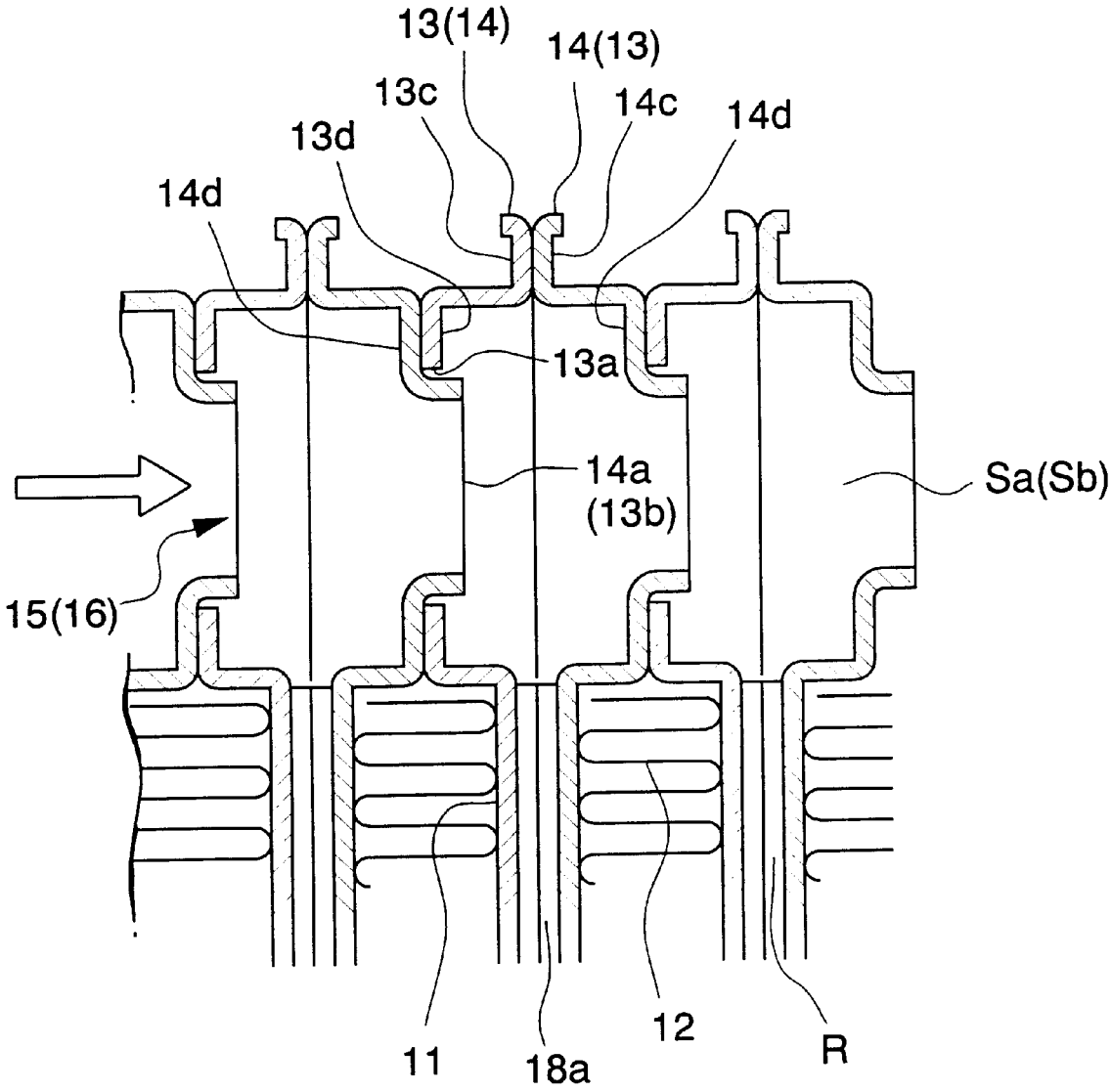
FIG. 11 is a cross sectional view showing a region including the vicinity of a space in the heat exchanger shown in FIG. 9.
Figure 12:
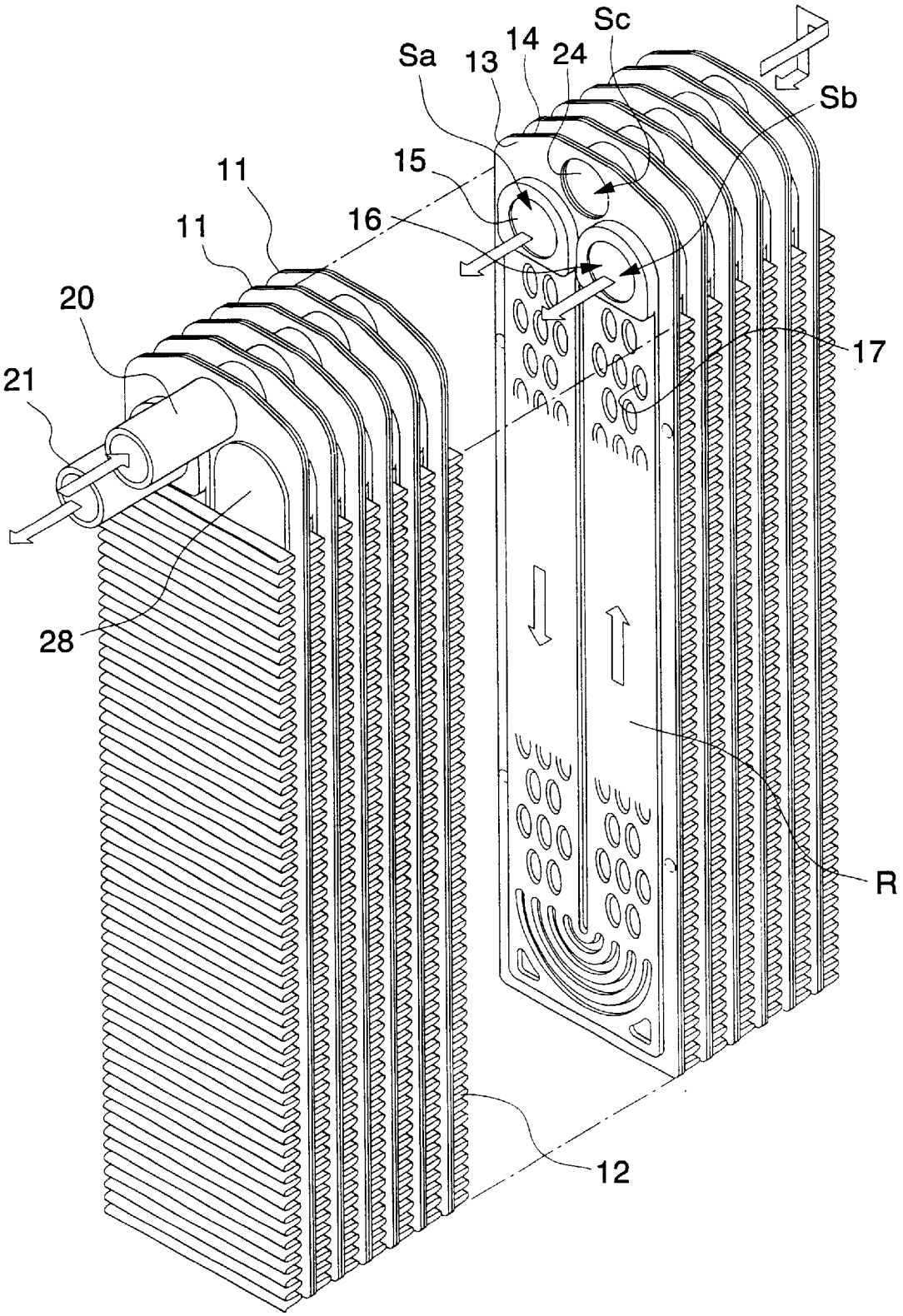
FIG. 12 is a perspective view showing an example of the structure of the conventional heat exchanger.
Figure 13:
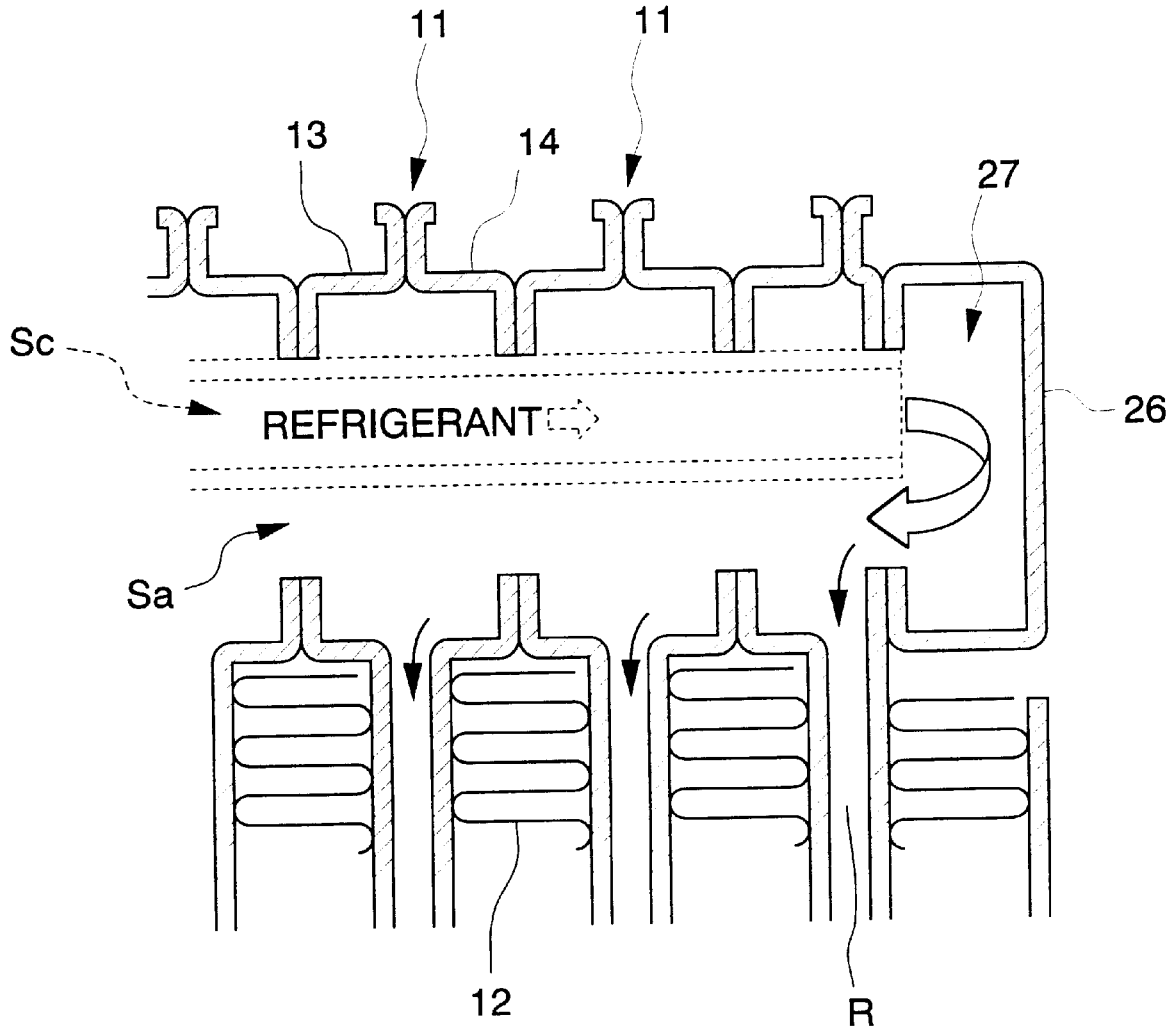
FIG. 13 is a cross sectional view showing a region including the vicinity of the distal end part of the space in the heat exchanger shown in FIG. 12.
Figure 14:
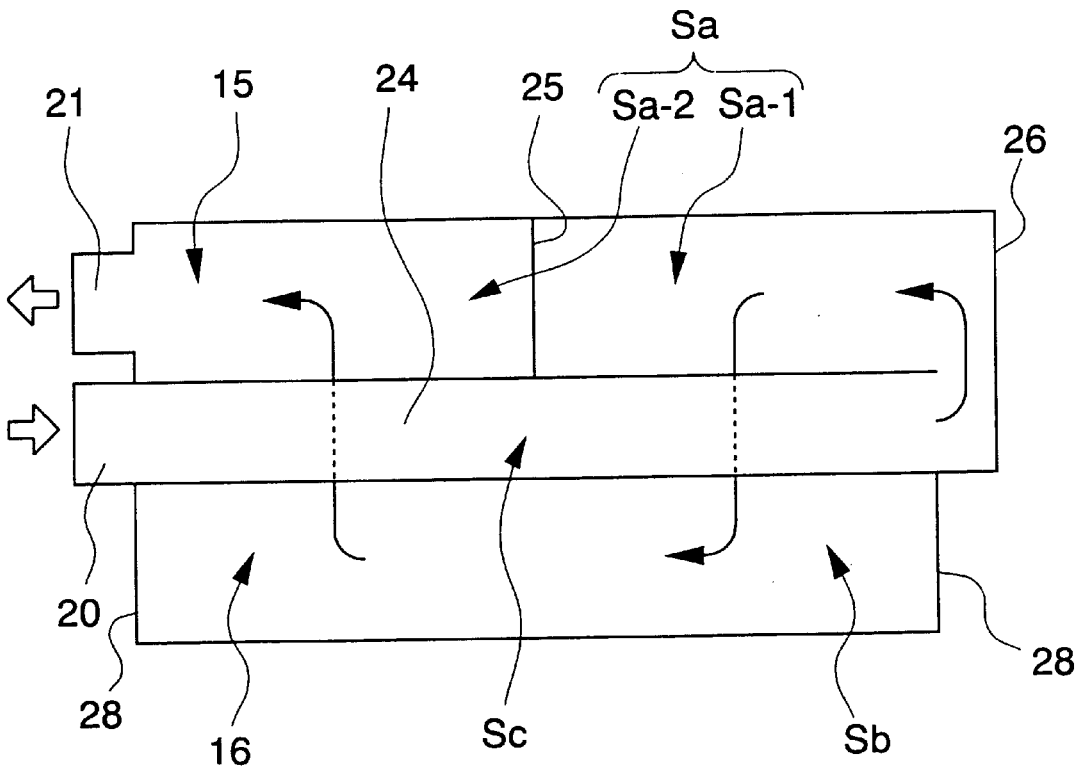
FIG. 14 is a schematic view showing the flow of the refrigerant in the heat exchanger shown in FIG. 12.

Another embodiment of the heat exchanger according to the present invention is illustrated in FIGS. 5 and 6. FIG. 5 shows the region including the vicinity of the distal end part of the space Sa of the heat exchanger. In this heat exchanger, a plate member 41 is overlaid on the distal end surface of the heat exchanger, and a side plate 42 is overlaid on the distal end surface of the plate member 41. Furthermore, a turning portion 43 is formed at the upper end part of the plate member 41 so as to face the spaces Sa and Sc, however, the turning portion does not face the space Sb.

The turning portion 43 is a concave portion with the concavity facing the distal end of the heat exchanger and is formed in one piece with the plate member 41. The turning portion 43 has a peripheral portion 43*a* which forms a curved surface having a circular arc shaped section, and a center portion 43*b* which is surrounded by the peripheral portion 43*a* and forms a flat surface. The center portion 43*b* is fastened to the upper part 42*a* of the side plate 42 at the back surface thereof.

Furthermore, a plurality of reinforcing projections (projecting portions) 44 are formed on the peripheral portion 43*a* as shown in FIG. 6. Each reinforcing projection 44 is provided as a convex shape which projects along the direction of the thickness of the plate member 41 and projects toward the spaces Sa, Sc. The remainder of the structure of the heat exchanger is the same as that of the heat exchanger shown in FIG. 12 though FIG. 14.

In the heat exchanger having the above structure, the flow of refrigerant flowing into the space Sc, turns at the turning portion 43 which is provided on the plate member 41 and flows into the space Sa. The refrigerant is then distributed to the refrigerant flow portions 11 which are positioned at the upstream end side (distal end side) of the heat exchanger and heat exchanged while it passes through each refrigerant flow path R. The refrigerant is collected in the space Sb and further distributed to the refrigerant flow portions 11 which are positioned at the downstream end side of the heat exchanger and passes through each refrigerant flow path R, and is collected at the space Sa-2.

In the heat exchanger as described above, since the turning portion 43 is supported by the side plate 42 from the back, the turning portion 43 is formed one piece with the plate member 41, the peripheral portion 43*a* forms a curved surface, and the reinforcing projections 44 are formed on the peripheral portion 43*a*; the strength of the turning portion 43 is improved and the turning portion 43 effectively resists the pressure acting on it. Therefore, a heat exchanger with a reduced weight and a minimized size, while maintaining the strength of the turning portion 27, can be obtained.

What is claimed is:

1. A head exchanger in which a plurality of refrigerant flow portions and cooling fins are alternatively layered, and each refrigerant flow portion is a plate-shaped and provides an internal refrigerant flow path by overlaying two flat plates formed by drawing, comprising:

an opening portion provided on each of said flat plates and which is connected with said refrigerant flow path;

a continuous space for the flow of said refrigerant which is provided by connecting the opening portions of adjacent refrigerant flow portions; and a side plate which covers one end of said layered refrigerant flow portions and cooling fins;

wherein said refrigerant which flows in said space is distributed to said refrigerant flow paths through said opening portions; and a means for improving the heat exchange capacity of said heat exchanger is provided, and this means is a narrowing means which is formed by extending a lower end of said side plate and has a plurality of pores in order to pass through said refrigerant is provided at an upstream end part of said space in order to uniformly distribute said refrigerant to the respective refrigerant flow paths, wherein a rectifier which is formed by extending a lower end of said narrowing means and rectifies the flow of said refrigerant along the longitudinal direction of said space is provided at a downstream end side of said space.

2. A heat exchanger according to claim 1, wherein said rectifier is provided adjacent to said narrowing means.

3. A heat exchanger according to one of claims 1 an 2, comprising:

a forward flow path in which said refrigerant flows form the proximal end of the heat exchanger to the distal end thereof; and a turning portion which is provided at the distal end in order to turn the flow of said refrigerant which flows from said forward flow path to said space;

wherein said turning portion is a concave portion which is formed at a plate member which is provided on a distal end surface of said heat exchanger, and a back surface of said turning portion is supported by a side plate which is provided on a distal end surface of said plate member.

4. A heat exchanger according to claim 3, wherein said turning portion has a center portion which forms a flat surface and a peripheral portion which forms a curved surface which smoothly continues from said center portion.

5. A heat exchanger according to claim 4, wherein a plurality of projecting portions which projecting along a direction of the thickness of said plate member are formed on said peripheral portion.

* * * * *